US009364132B2

(12) United States Patent
Gherardi

(10) Patent No.: US 9,364,132 B2
(45) Date of Patent: Jun. 14, 2016

(54) BALANCED HINGE DEVICE WITH BRAKE

(71) Applicant: C.M.I. Cerniere Meccaniche Industriali S.r.l., Crespellao (BO) (IT)

(72) Inventor: Eros Gherardi, Bologna (IT)

(73) Assignee: Cerniere Meccaniche Industrial S.r.l., Crespellano (BO) (IT)

( * ) Notice: Subject to any disclaimer, the term of this patent is extended or adjusted under 35 U.S.C. 154(b) by 62 days.

(21) Appl. No.: 14/399,578

(22) PCT Filed: May 8, 2013

(86) PCT No.: PCT/EP2013/059680

§ 371 (c)(1),
(2) Date: Nov. 7, 2014

(87) PCT Pub. No.: WO2013/167708

PCT Pub. Date: Nov. 14, 2013

(65) Prior Publication Data

US 2015/0107053 A1 Apr. 23, 2015

(30) Foreign Application Priority Data

May 9, 2012 (IT) ..... BO2012A0257

(51) Int. Cl.
*E05D 11/08* (2006.01)
*A47L 15/42* (2006.01)
(Continued)

(52) U.S. Cl.
CPC ..... *A47L 15/4261* (2013.01); *E05D 11/08* (2013.01); *E05F 1/1261* (2013.01);
(Continued)

(58) Field of Classification Search
CPC ..... Y10T 16/53822; Y10T 16/53824; Y10T 16/5383; Y10T 16/53832; Y10T 16/53833; Y10T 16/53834; Y10T 16/53835; Y10T 16/53838; Y10T 16/5385; Y10T 16/153883; Y10T 16/53885; Y10T 16/5403; Y10T 16/54035; A47L 15/4261; F24C 15/023; E05F 1/1246; E05F 1/1253; E05F 1/1261; E05F 1/1269; E05F 1/1276; E05D 11/088; E05D 11/08; E05D 11/06
See application file for complete search history.

(56) References Cited

U.S. PATENT DOCUMENTS 2,626,420 A * 1/1953 Mongin ..... E05F 1/1253 16/79
2,668,320 A * 2/1954 Lustig ..... E05D 3/06 16/289

(Continued)

FOREIGN PATENT DOCUMENTS

EP 1302150 A1 4/2003

OTHER PUBLICATIONS

International Search Report for PCT/EP2013/059680, dated Jul. 18, 2013, 9 pages.

*Primary Examiner* — Jeffrey O Brien
(74) *Attorney, Agent, or Firm* — Ware, Fressola, Maguire & Barber LLP

(57) ABSTRACT

A balanced hinge device with a brake has a first connector (3) adapted to be fixed to a structure or frame and connected via at least a kinematic element (8) to a second connector (5) adapted to be fixed to a door or a shutter. The device (1) has at least one friction part (9) fixed to at least one among the first connector (3), the second connector (5) and the kinematic element (8). Each friction part (9) slidably contacts, at least at a predetermined rotation arc of one connector (3, 5) with respect to the other connector, a portion of at least one among the first connector (3), the second connector (5) and the kinematic element (8) and with at least a contact (11).

13 Claims, 6 Drawing Sheets

(51) Int. Cl.
*E05F 1/12* (2006.01)
*F24C 15/02* (2006.01)

(52) U.S. Cl.
CPC ..... *F24C15/023* (2013.01); *E05Y 2201/26* (2013.01); *E05Y 2201/266* (2013.01); *E05Y 2201/712* (2013.01); *E05Y 2201/716* (2013.01); *E05Y 2201/722* (2013.01); *E05Y 2900/304* (2013.01); *E05Y 2900/308* (2013.01); *Y10T 16/53833* (2015.01); *Y10T 16/5403* (2015.01)

(56) References Cited

U.S. PATENT DOCUMENTS 2,721,547 A * 10/1955 Pollock ..... F24C 15/023 126/191
3,450,125 A * 6/1969 Hopkins ..... F24C 15/023 126/191
3,466,105 A * 9/1969 Guth ..... A47L 15/4261 126/340
3,820,866 A * 6/1974 Kaldenberg ..... A47L 15/4261 312/276
4,021,968 A * 5/1977 Kendall ..... E05F 1/1075 126/191
5,025,776 A * 6/1991 Hanley ..... E05F 1/1276 126/194
6,789,293 B2 * 9/2004 Habegger ..... E05F 1/1276 16/289
6,968,597 B2 * 11/2005 Habegger ..... E05D 11/1064 126/194
6,986,187 B2 * 1/2006 Cummins ..... E05F 1/1276 126/194
7,017,232 B1 * 3/2006 Priddy ..... E05F 1/1276 16/286
8,201,304 B2 * 6/2012 Steurer ..... E05F 1/1261 126/194
8,250,707 B2 * 8/2012 Donoho ..... E05F 1/1276 16/286
8,925,542 B2 * 1/2015 White ..... E05F 1/1261 126/190
9,145,722 B2 * 9/2015 Gherardi ..... E05D 11/08
2003/0172920 A1 * 9/2003 Gronbach ..... E05D 7/12 126/197
2013/0291853 A1 * 11/2013 Braden ..... E05D 7/04 126/19 R

* cited by examiner

BALANCED HINGE DEVICE WITH BRAKE

CROSS REFERENCE TO RELATED APPLICATIONS

This application is a National Stage of PCT International application no. PCT/EP2013/059680, filed 8 May 2013, which claimed priority in Italian patent application no. BO2012A 000257, filed 9 May 2012, the contents of these applications being incorporated herein by reference.

TECHNICAL FIELD

The present invention relates to the field of hinges and refers to a balanced hinge device with a brake particularly suitable for appliances such as dishwashers and in general for doors and shutters having a horizontal rotation axis for craft and industrial equipment, electrical apparatus, furniture and furnishings.

BACKGROUND

There are known hinges for doors or shutters having a lower horizontal rotation axis, equipped with elastic elements and friction elements assigned respectively to balance the door weight and to allow the slowing down and/or the stopping and levelling off in one or more positions of the door.

One disadvantage of some of these known hinges consists in that the braking action exerted by the friction elements acts throughout all the hinge rotation arc slowing down the door in every position preventing or making difficult to obtain some functionalities.

Another disadvantage of some known hinges consists in that the friction elements are very complex and bulky.

Further disadvantage of some of such known hinges consists in that the forces transmitted by the several elements and parts of the hinge are very high and exercise very intense stress so require the use of oversized, very robust and high accuracy machined materials, the elements and parts becoming very expensive, extremely overweighed and oversized, they thus cause significant wear and excessive sensitivity to accidental liquids presence, detergents or oils due to the excessive friction reduction due to such materials.

Another disadvantage consists in that these known hinges generally do not allow a final closure free stroke having sufficient force to achieve the closing lock of the door by the respective lock.

SUMMARY OF THE INVENTION

An object of the present invention is to propose a balanced hinge device with a brake suitable to exert a braking action in one or more predetermined sectors of the rotation arc of the hinge and to reduce or eliminate the braking action in the other sectors.

Another object is to provide a compact device reliable and long lasting that it is feasible to easily obtain braked rotation sectors and not depending on the needs and desired functions.

A further object is to provide a balanced hinge device with brake suitable to balance the door weight and that is light, cheap, small and reliable.

Another object is to provide a device suitable to keep the door locked in one or more ranges of angular positions of the same.

A further object is to provide a device able to keep the door elastically locked in one or more angular positions.

Another object is to provide a device allowing the door to have a free final closure stroke with a force sufficient to cause the door lock to close.

A further object is to provide a device whose actuation and friction characteristics can be easily modified and/or set-up during the production stage by substituting one or two parts.

BRIEF DESCRIPTION OF THE DRAWINGS

The characteristics of the invention are highlighted in the following with particular reference to the accompanying drawings in which the orientations are related to a condition wherein the device is fixed or joined to the apparatus not shown.

DETAILED DESCRIPTION OF THE INVENTION

Figure 1:
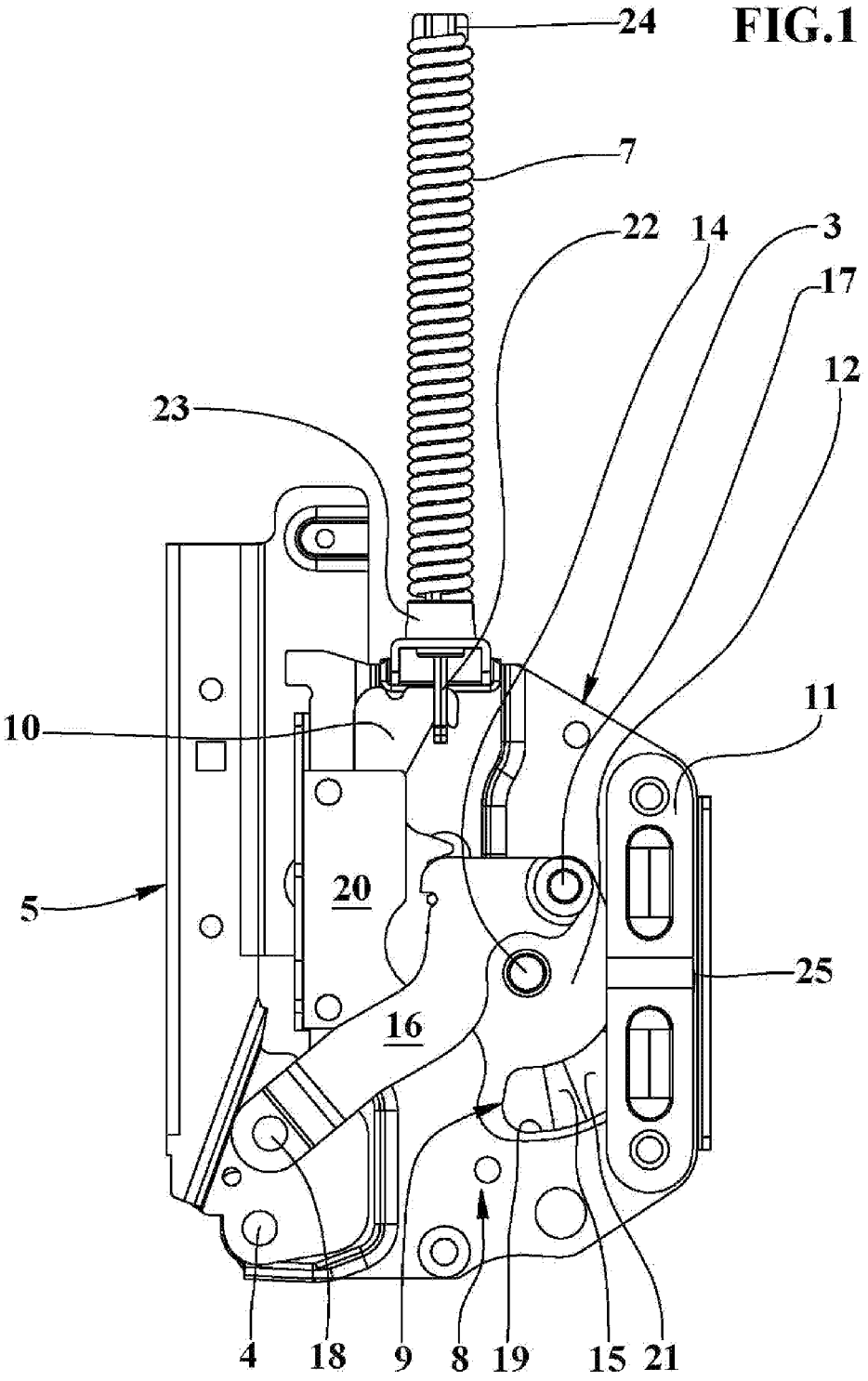
FIG. 1 shows a schematic side view of the balanced hinge device with brake object of the present invention in a close condition.
Figure 2:
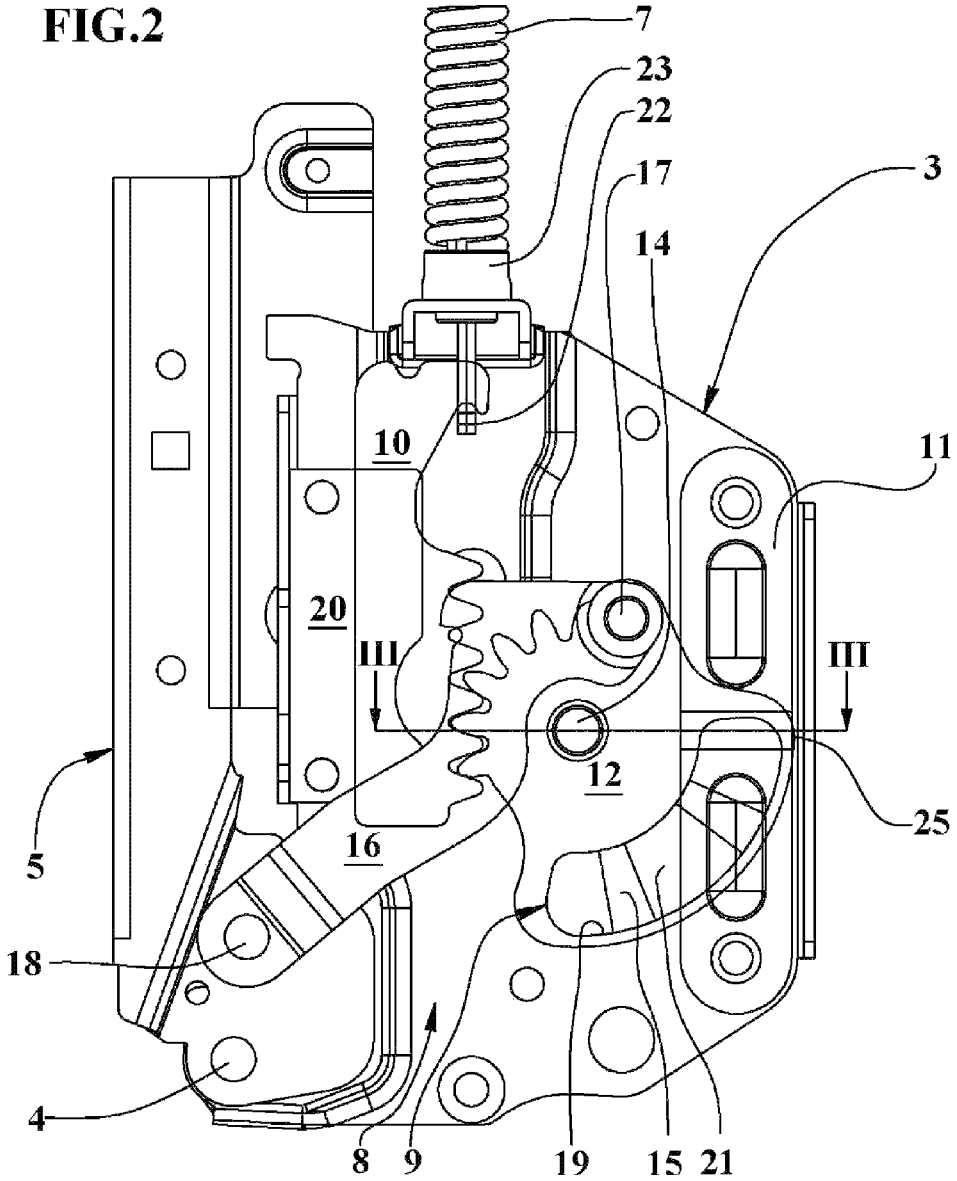
FIG. 2 shows a partial enlarged view and the device of FIG. 1 wherein some elements are represented in transparency to show the underlying elements.
Figure 3:
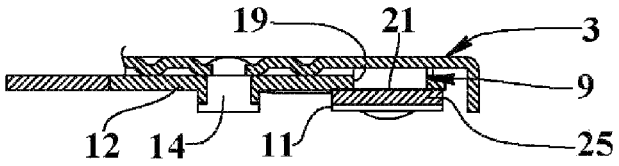
FIG. 3 shows a section view along the plane III-III of FIG. 2.
Figures 4, 5, 6:
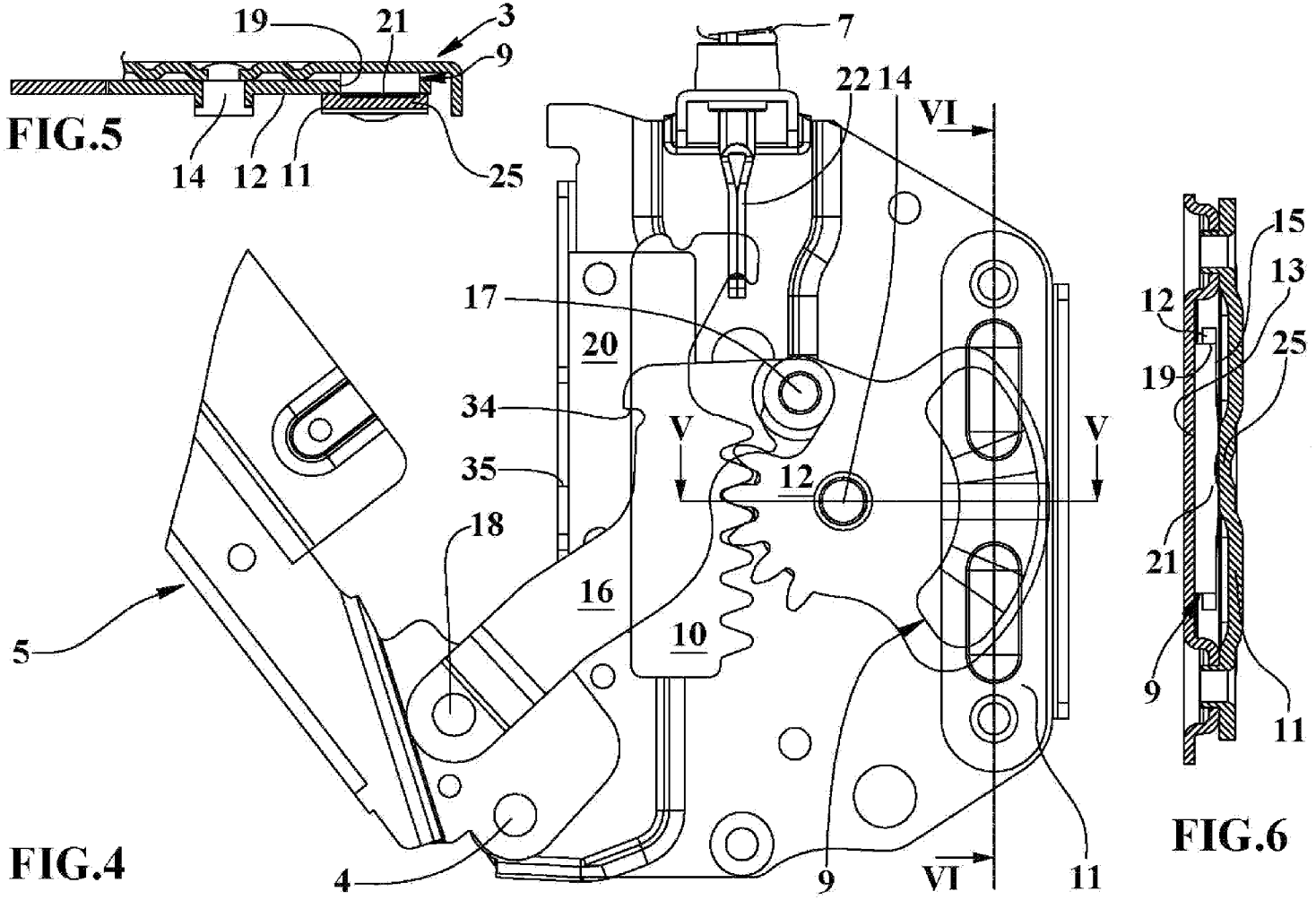
FIG. 4 shows a schematic, partial, enlarged and in transparency of the device of FIG. 1 in a condition of partial opening.
FIGS. 5 and 6 show section views respectively according to the planes V-V and VI-VI of FIG. 4.
Figure 7:
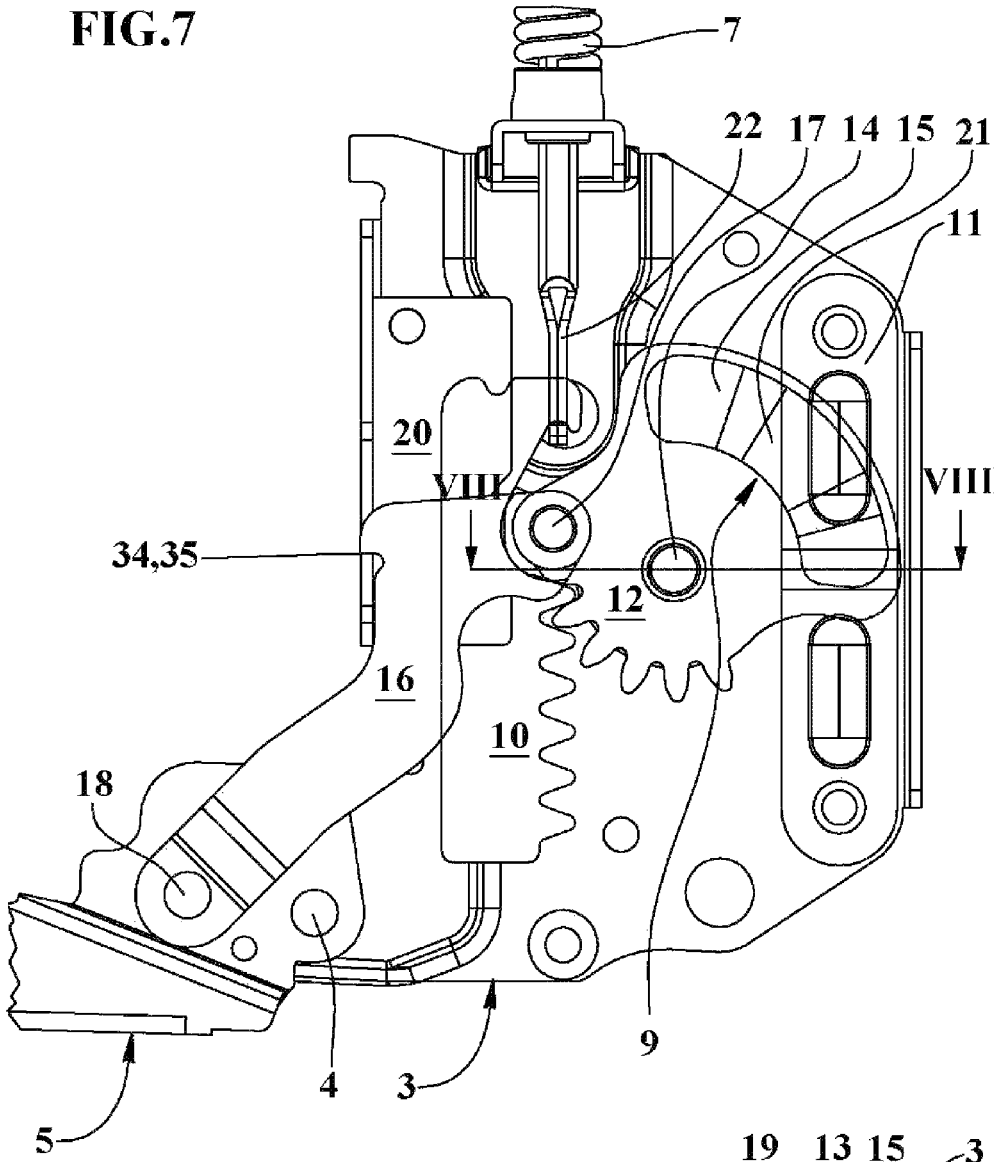
FIG. 7 illustrates the device of FIG. 4 in a full open condition.
Figure 8:
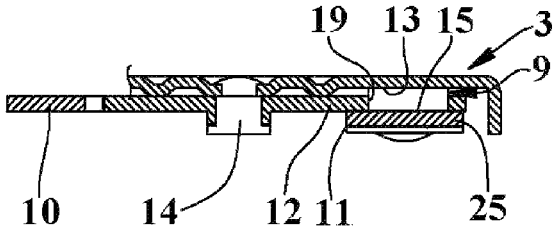
FIG. 8 shows a section view along the plane VIII-VIII of FIG. 7.
Figure 9:
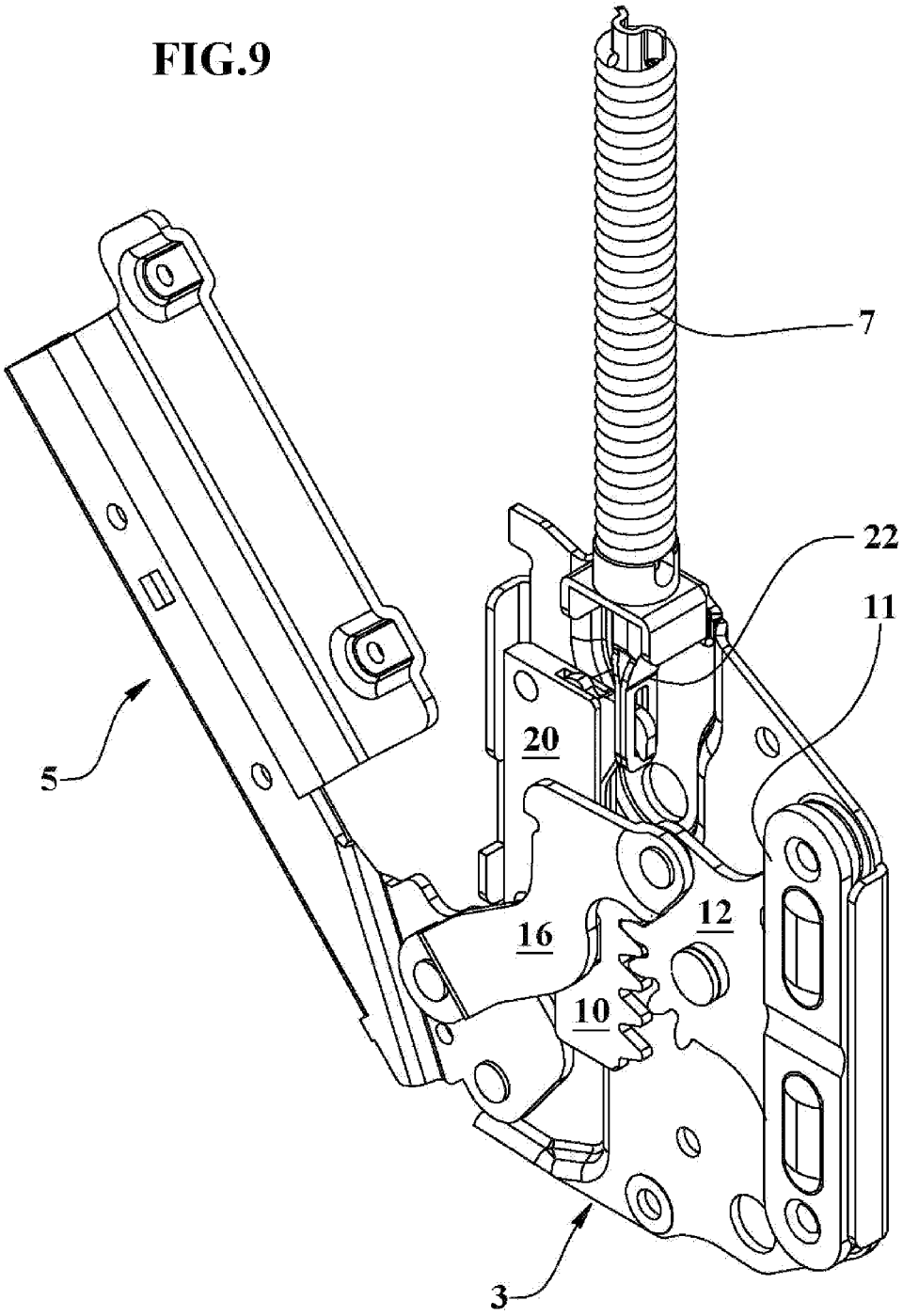
FIG. 9 shows an isometric view of the device of FIG. 1 in partial closure condition.
Figure 10:
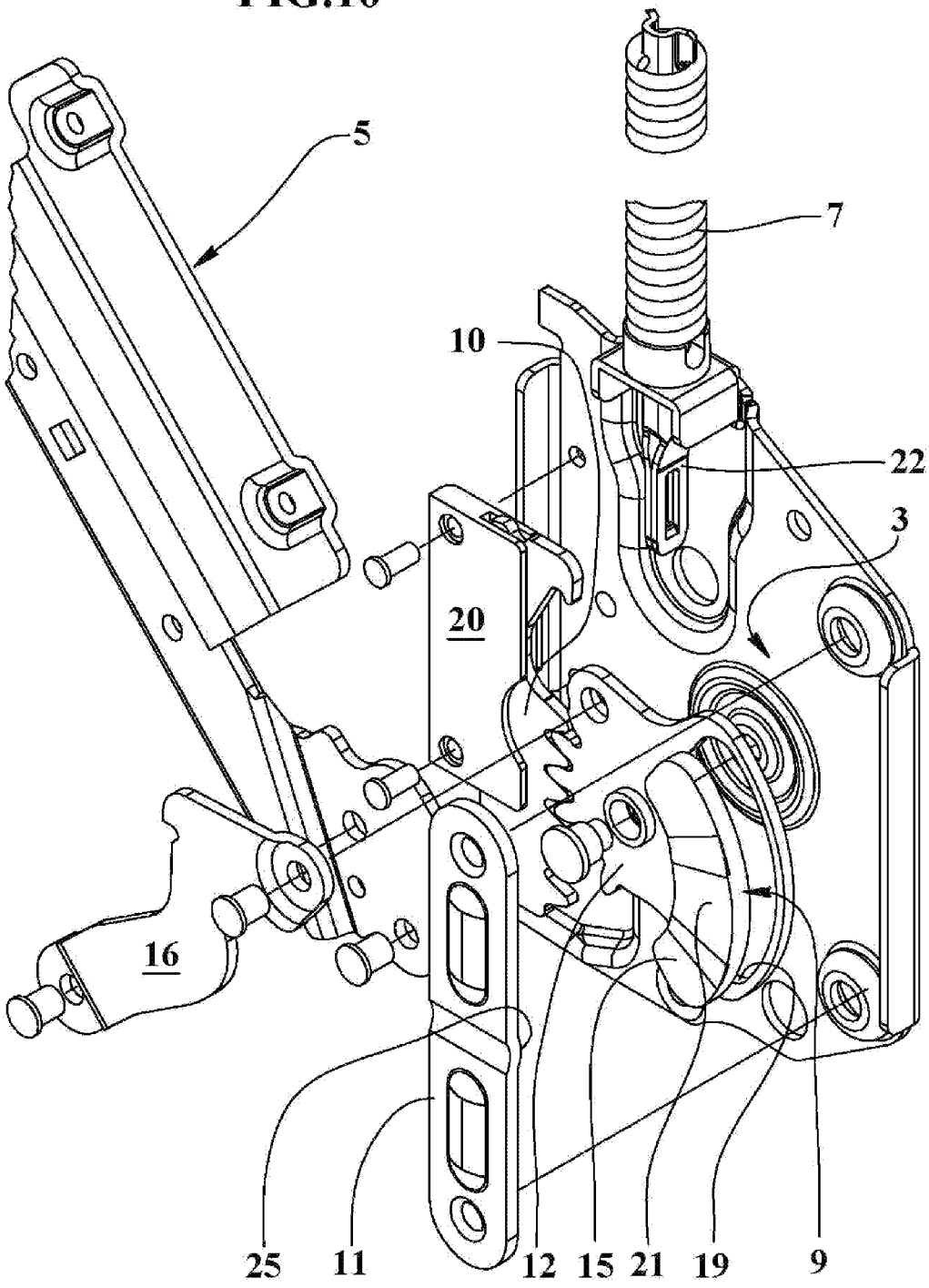
FIG. 10 shows an exploded view of FIG. 9 wherein some elements are only partially illustrated.

With reference to FIGS. 1 to 10, numeral 1 indicates the balanced hinge device with brake, object of the present invention and comprising a first connecting means 3, preferably made of cut and moulded metal sheet and being mainly flat shaped, assigned to be fixed to a structure or frame such as a dishwasher or another type of apparatus. One end of the first connecting means 3 which in the device operating condition is placed inferiorly in relation to the latter, is pivotally connected via a second pin 4 of the hinge to a second connecting means 5, also preferably made of cut and moulded metal sheet and being mostly flat shaped, assigned to be fixed to a door or shutter of the dishwasher or other apparatus.

Such connecting means 3, 5 are also mechanically connected to compensating elastic means 7 by kinematic means 8 transmitting to said connecting means 3, 5 a mutual approaching elastic force. The elastic means 7 are connected to the first connecting means 3, in particular they are protruding and they are arranged at one end of the first connecting means 3 opposite to the second pin 4, and therefore in the operating condition protrude upward.

This elastic force produced by the elastic means 7, in the operating condition is assigned to balance the gravitational force acting on the door, opposing to the latter.

Such kinematic means 8 comprise a rack means 10 constrained to slide itself parallel by sliding means 20 and a pinion means 12 axially constrained to rotate about a respective first rotation pin 14 fixed to the first connecting means 3.

The rack means 10 and the pinion means 12 bear corresponding toothed sectors respectively rectilinear and disposed along a circumference arc, mutually engaging transforming the reciprocating circular motion of the pinion means 12 in reciprocating linear motion of the rack means 10.

The sliding means 20 comprise at least one guide having a "U" shaped concave section, alternatively, comprise an elongated slot formed through the thickness in the rack means 10 and having elongated sides parallel to the longitudinal axis of the rack means 10 itself and also include a slider, for example in anti-friction plastic material shaped as a soap bar, fixed to the first connecting means 3, in both cases, the rack means 10 can slide itself parallel without jamming.

The rack means 10 is resiliently pressed by the elastic means 7 which transmits the elastic force to the pinion means 12.

The kinematic means 8 comprise also an arm means 16 whose ends are connected through respective third 17 and fourth 18 connecting pins respectively to the pinion means 12 and the second connecting means 5.

So the elastic force of the elastic means 7 is transmitted through the arm means 16 by the pinion means 12 to the second connecting means 5 pulling the latter towards the first connecting means 3.

The first rotation pin 14 of the pinion means 12 is fixed to the first connecting means 3.

The first 3 and second 5 connecting means, the rack means 10, the pinion means 12 and the arm means 16 lie approximately on respective parallel geometric planes.

The geometric axes of the first 14, second 4, third 17 and fourth 18 pins are perpendicular to said geometric plans.

The distance between the geometric axes of first 14 and third 17 pins is approximately equal to or greater than the engaging radius of the pinion means 12 teeth.

The toothed sector of the pinion means 12 subtends an angle between about 90° and about 180°; the linear development of this toothed sector of the pinion means 12 has a length approximately equal to the length of the corresponding toothed sector of the rack means 10.

The distance between the axes of the second 4 and fourth 18 pins is between half and twice, preferably approximately equal, the distance between the axes of the first 14 and third 17 pins. Preferably, and as shown in the figures, said pins 4, 14, 17, 18 are placed at the vertices of a deformable parallelogram geometric quadriside.

The rack means 10 is elastically pressed by the elastic means 7 via a rod means 22.

The elastic means 7 are a helical spring and whose ends are compressed between a contact 23 of the first connecting means 3, for example cup shaped, and a contact 24 of the rod means 22 having a thin elongated portion connecting the respective contacts 24, consisting of an enlarged head, to its connection to the rack means 10 through the axial slot of said helical spring.

In full open condition two lower portions of the first 3 and second 5 connecting means contact each other blocking any further rotation that can increase the angle between these connecting means.

To stiffen and reinforce the device in the full open condition, the arm means 16 is provided with a first contact means 34, for example consisting of a its side shoulder, in the full open condition, assigned to contact a second contact means 35, consisting for example in a projecting and folded side flap of the first connecting means 3.

The device 1 comprises a friction means 9 fixed to the pinion means 12 of the kinematic means 8 that sliding contacts, with mutual sliding, the first connecting means 3 and a contact means 11.

A first side portion 13 of the friction means 9, or one of its two main faces, slidably contacts a flat portion of the first connecting means 3 or an element fixed to it, and a second portion 15 of the friction means 9, or its other main face, contacts, at least at a predetermined rotation arc of the device 1, the contact means 11.

The pinion means 12 has a through hollow seat 19 to accommodate, at least partially, the friction means 9 so that the seat 19 wall contacts the perimeter faces of the friction means 9.

The seat 19 consists of a shaped slot formed through the pinion means 12 and the friction means 9 consists of a body approximately plane and shaped in a complementary way to the respective seat 19.

The contact means 11 is approximately shaped as a bridge with ends fixed to the first connecting means 3 with which defines a partial housing for the pinion means 12 and for the friction means 9.

As above described, the first side portion 13 of the friction means 9 and the corresponding surface of the first connecting means 3 are nearly flat while the second portion 15 of the friction means 9 and the face of the contact means 11 facing the pinion means 12 have respective jutting parts 21, 25 assigned for mutual contact by sliding friction in correspondence of the predetermined rotation arc at which it is necessary that the friction is increased with an intensity depending mainly on the geometric shape and the friction means 9 and the contact means 11 types.

The jutting part 21 of the friction means 9 is nearly flat and it is joined to the other corresponding second portion 15 of the friction means 9 by means of bevelled end terminations.

The jutting part 25 of the contact means 11 is facing towards the friction means 9 and consists, for example, in a moulded transverse rib of the contact means 11 itself.

The seat 19 has an angular extension, with respect to the rotation centre of the pinion means 12, such as the surface of the seat 19 sweeps the entire surface of the face of the contact means 11 that is facing towards the pinion means 12 during the device complete rotation.

The friction means 9 is made of plastic, nylon, Teflon, or similar also reinforced with fibres.

The invention provides that most of the elements of the device are made of cut and moulded sheet metal. The thickness of the rack means 10 and the pinion means 12 can be greater than that of the other elements to ensure a good engagement and wear resistance. In correspondence of the pivoting couplings between the pins and the respective seats, these latter can be equipped with optional bushings.

The operation of the device, starting from a maximum opening condition in which the first 3 and second 5 connecting means are at the maximum mutual angular distance and the elastic means 7 are at maximum compression, provides that the elastic force of these elastic means 7 transmitted by the kinematic means 8 to the second connecting means and to the door, balances the weight of the latter allowing easy manual lifting. The friction between the contact means 11 and the friction 9 depends on the opening angle and their angular trends can be predetermined properly configuring the second portion 15 of the friction means 9 and in particular the jutting parts 21, 25.

A simple variant of the invention, not figured, provides that the friction means 9 is fixed to the rack means 10 instead of the pinion means 12 and the contact means 11 is overlapped on the rack means 10, or obtained in a side of the sliding means 20.

An advantage of the present invention is to provide a balanced hinge device with a brake suitable to exert a braking action in one or more preset sectors of the rotation arc of the hinge and to reduce or eliminate the braking action in the other sectors.

Other advantage is to provide a compact device reliable and long lasting that it is feasible to easily obtain braked rotation sectors and not depending on the needs and desired functions.

Another advantage is to provide a balanced hinge device with brake suitable to balance the door weight and that it is light, cheap, small and reliable.

Other advantage is to provide a device suitable to keep the door locked in one or more ranges of angular positions of the same.

Further advantage is to provide a device able to keep the door elastically locked in one or more angular positions.

Other advantage is to provide a device allowing the door to have a free final closure stroke with a force sufficient to cause the door lock closing.

Further advantage is to provide a device whose actuation and friction characteristics can be easily modified and/or set-up during the production stage by substituting one or two parts.

The invention claimed is:

1. A balanced hinge device having a brake comprising:

a first connector adapted to be fixed to a structure or frame and connected at least by kinematic element to a second connector adapted to be fixed to a door or a shutter;

a friction part;

an elastic element balancing a weight of the door or the shutter connected to the kinematic element for transmitting to the first and second connectors a mutual approaching elastic force generated by said elastic element;

the friction part being fixed to a member of the kinematic element;

a first side portion of the friction part slidable onto at least one among the first connector, the second connector or an element fixed to one of the first and second connectors;

a second side portion of the friction part, at least in correspondence to at least one predetermined rotation arc of the hinge device being slidable onto a contact member;

wherein the kinematic element includes a rack elastically actuated by the elastic element, a pinion constrained to axially rotate around a respective first pin connected to the second connector;

wherein said rack and pinion are reciprocally engaged and the pinion has a seat for receiving the friction part whose first side portion contacts the first connector or an element fixed to the first connector, a second side portion, located opposite to the first side portion being slidable, in correspondence of the at least one predetermined arc, onto the contact member fixed to the first connector, the seat being a shaped slot obtained in the pinion and the friction part being a body that is approximately flat and having a shape complementary to a shape of the seat;

the kinematic element having a second pin forming a mutual revolving connection of the first connector and the second connector;

an arm having ends connected by a third pin and a fourth pin to the pinion and to the second connector, respectively.

2. The hinge device according to claim 1 wherein the first side portion of the friction part and a corresponding surface of the first connector are substantially flat;

wherein the contact member has an approximate bridge shape, said bridge shape having ends fixed at the first connector for defining a partial housing for the pinion and for the friction part;

wherein the second side portion of the friction part, and a face of the contact member facing towards the pinion, have respectively jutting parts adapted to engage in mutual contact by sliding friction in correspondence with said predetermined rotational arc.

3. The hinge device according to claim 2 wherein the jutting part of the friction part is substantially flat and is joined to a remaining second corresponding portion of the friction part by bevelled ends, the jutting part of the contact member facing the friction part.

4. The hinge device according to claim 1 wherein the seat has an angular extension, with respect to a rotation center of the pinion, such that a surface of the seat sweeps the whole surface of the contact member facing towards the pinion during a complete rotation of the device.

5. The hinge device according to claim 1 wherein the friction part is made of a material selected from the group consisting of nylon, polytetraflouroethylene, and a fiber reinforced plastic.

6. The hinge device according to claim 1 wherein the first pin is fixed to the first connector, the first connector lying on a plane parallel to laying planes of the second connector, the rack, the pinion and the arm.

7. The hinge device according to claim 6 wherein the first pin, the second pin, the third pin and the fourth pin are perpendicular to said laying planes, a distance between axes of the first pin and the third pin being the same or bigger than an engagement radius of teeth of the pinion, wherein such teeth are distributed on a sector of the pinion that subtends an angle ranging between about 90° and about 180°.

8. The Device according to claim 7 wherein a distance between the axes of the second pin and the fourth pin is between one half and double of the distance between the axes of the first and third pins;

wherein said first, second, third and fourth pins are planed to form vertices of a quadrilateral.

9. The hinge device according to claim 1 wherein the rack is constrained to slide along a longitudinal axis thereof by a slide; the slide including at least one concave guide having "U" shaped cross-section.

10. The hinge device according to claim 9 wherein the rack is elastically actuated by the elastic element through a tie-rod, and the elastic element being at least one compressed helical spring having ends engaged with the first connector and the tie-rod.

11. The hinge device according to claim 7 wherein a distance between the axes of the second pin and the fourth pin is substantially the same as the distance between the axes of the first and third pins;

wherein said first, second, third and fourth pins are placed to form vertices of a quadrilateral.

12. The hinge device according to claim 8 wherein the quadrilateral is a parallelogram.

13. The hinge device according to claim 11 wherein the quadrilateral is a parallelogram.

* * * * *